US005562151A

United States Patent [19]

Nakagawa et al.

[11] Patent Number: 5,562,151

[45] Date of Patent: Oct. 8, 1996

[54] METHOD AND APPARATUS FOR PRODUCING THIN RIBBON

[75] Inventors: Kenji Nakagawa; Nozomu Tamura; Saburo Moriwaki, all of Chiba; Kiyoshi Shibuya, Tokyo; Shun Suhara, Chiba; Kazuyuki Katoh, Chiba; Toru Sato, Chiba; Toshitane Matsukawa, Chiba, all of Japan

[73] Assignee: Kawasaki Steel Corporation, Japan

[21] Appl. No.: 261,347

[22] Filed: Jun. 16, 1994

[30] Foreign Application Priority Data

| | | | |
|---|---|---|---|
| Jun. 18, 1993 | [JP] | Japan | 5-147512 |
| Jan. 31, 1994 | [JP] | Japan | 6-009417 |
| Jan. 31, 1994 | [JP] | Japan | 6-009418 |

[51] Int. Cl.$^6$ ..... B22D 11/06; B22D 11/12

[52] U.S. Cl. ..... 164/463; 164/417; 164/423

[58] Field of Search ..... 164/417, 463, 164/479, 423, 429, 483; 226/10, 45, 170

[56] References Cited

U.S. PATENT DOCUMENTS

| | | | |
|---|---|---|---|
| 5,207,777 | 5/1993 | Shibuya et al. | 164/477 |
| 5,392,837 | 2/1995 | Yukumoto et al. | 164/417 |

*Primary Examiner*—Joseph J. Hail, III
*Assistant Examiner*—I. Lin
*Attorney, Agent, or Firm*—Austin R. Miller

[57] ABSTRACT

Apparatus and method of producing a thin metal ribbon by pouring a molten metal onto the surface of a quench roll rotating at a high speed so as to rapidly cool and solidify the metal to form the ribbon, separating the ribbon from the quench roll and conveying the same to a take-up device. A compressed gas is blown tangent to the quench roll to separate the ribbon from the quench roll. The separated ribbon is sucked and caught by a suction conveyor which runs at a velocity greater than the speed of production of the thin meal ribbon thereby imparting tension to the ribbon.

8 Claims, 13 Drawing Sheets

METHOD AND APPARATUS FOR PRODUCING THIN RIBBON

BACKGROUND OF THE INVENTION

1. Field of the Invention

The present invention relates to a method of and an apparatus for producing a thin metal ribbon by quenching employing a quench roll. More particularly, the present invention pertains to novel separation, guiding and transfer of the thin metal ribbon immediately after being peeled off the quench roll.

In recent years, progress has been made in production of thin metal ribbons by quenching using a quench roll. In order to carry out this process industrially, it is important to be able to wind and take up the quench-solidified thin metal ribbon into a coil at high velocity.

2. Related Applications

Applicants' assignee, Kawasaki Steel Corporation of Tokyo Japan is also the assignee of the following pending U.S. applications which relate to separation and guiding of thin strip produced by casting: U.S. Ser. No. 08/072,778, filed Jun. 7, 1993; U.S. Ser. No. 08/121,184, filed Sep. 14, 1993, and now U.S. Pat. No. 5,392,837; and U.S. Ser. No. 08/193,444 filed Feb. 8, 1994, and now U.S. Pat. No. 5,456,308.

3. Description of the Related Art

Means for guiding, conveying and taking up a thin metal ribbon can be broadly sorted into two types: namely, a first type in which a take-up reel is moved to a region in the vicinity of the quench roll so that the thin metal ribbon is attracted by and wound on the reel, and a second type in which the thin metal ribbon is conveyed and delivered to and wound on a take-up reel which is spaced apart from the quench roll.

An example of the first type is disclosed in Japanese Patent Laid-Open No. 57-95553, wherein the end of the thin metal ribbon is magnetically attracted to enable coiling.

An example of the second type is disclosed in Japanese patent Laid-Open No. 1-92716. This apparatus provides means for storage of the quench-formed thin metal ribbon, means for detecting the amount stored, and a control device for controlling the speed of the take-up roll. In one embodiment a pneumatic suction nozzle is used for conveying the thin metal ribbon to the storage section and further to the take-up reel, after the separation from the quench roll.

A ribbon take-up apparatus of the second type also is shown in Japanese patent Laid-Open No. 57-39030, wherein an air sucking roll is used.

Japanese Patent Laid-Open No. 62-45455 proposes a technique in which the thin metal ribbon is conveyed from a quench roll to a take-up reel while being clamped by clamping means such as a pair of endless belts.

Various other methods also have been proposed such as using a conveyor belt incorporating magnetic means (Japanese Patent Laid-Open No. 55-36029), employing a running ejector (Japanese Patent Laid-Open No. 62-151251), and a pair of pinch rolls carried by a conveyor truck, one of the rolls being a brush roll (Japanese Patent Laid-Open No. 3-77752).

The method disclosed in Japanese Patent Laid-Open No. 57-95553 encounters a problem in that it is not easy to magnetically attract the leading end of the thin metal ribbon without fail, because of lack of stability of the leading end of the ribbon. This instability is caused by instability of conditions such as quench roll temperature, molten metal temperature, injection pressure and operation of the injection nozzle. These are typically unstable in the period immediately after starting production.

The method disclosed in Japanese patent Laid-Open No. 1-92716 employs a pneumatic suction nozzle for conveying the thin metal ribbon separated from the quench roll to the storage section, and further to the take-up roll. In general, however, the ribbon separation point at which the thin metal ribbon leaves the quench roll is not steady and moves from time to time. In addition, the surrounding conditions are unstable immediately after the start of the operation, as described above. It is therefore difficult to catch the thin metal ribbon with the pneumatic suction nozzle. In addition, when the thin metal ribbon is wide, the ribbon tends to flutter within the guide duct and hamper stable conveyance, even if the ribbon is caught by the pneumatic suction nozzle.

The method disclosed in Japanese Patent Laid-Open No. 57-39030 also is disadvantageous in that the delivery of the thin metal ribbon from the quench roll to the take-up roll cannot be performed smoothly since the pneumatic suction roll cannot apply high enough tension to the thin metal ribbon.

The method shown in Japanese patent Laid-Open No. 62-45455 also has a drawback in that it is not easy to clamp, by means of the endless belt, the leading end of the thin metal ribbon which is being produced at a high speed. In addition, the thin metal ribbon tends to break, especially when the thin metal ribbon is wide.

The method disclosed in Japanese Patent Laid-Open No. 55-36029 employs a moving magnetic field and magnetic force for conveying the thin metal ribbon. This method meets with a problem in that it is not easy to provide a magnetic attracting force that is strong enough to ensure stable conveyance of the ribbon because of extreme thinness of the ribbon. Moreover, a repulsion force may be produced, depending on the manner of application of the magnetic force.

The technique shown in Japanese Patent Laid-Open No. 62-151251 also suffers from a disadvantage in that it is not easy to develop uniform tension in the breadthwise direction of the thin metal ribbon, so that the thin metal ribbon tends to break when the width of the ribbon is increased.

Finally, in the method disclosed in Japanese Patent Laid-Open No. 3-77752, the traction tension imparted to the thin metal ribbon tends to become non-uniform as a result of local damage or secular change in the brush pinch roll, because the traction tension is determined by the pressing force exerted by the pinch rolls and the coefficients of friction between the pinch rolls and the thin metal ribbon.

SUMMARY OF THE INVENTION

This invention is directed to overcoming the foregoing problems, and is directed to producing a thin metal ribbon so that it leaves the quench roll at a steadily maintained fixed position. It is also directed to a method wherein tension is effectively and securely applied to the ribbon as it is separated at a fixed location from the quench roll. This ensures that the ribbon may be guided and conveyed by a suction conveyor to a take-up device without fail.

It is an important feature of the present invention to blow or jet a compressed gas in a direction toward the desired separation point, preferably substantially tangent to the quench roll so as to separate the ribbon from the quench roll at a stable location, and to provide a suction conveyor arranged to suck and catch the ribbon in the vicinity of the same ribbon separation point to convey the ribbon toward the take-up end of the apparatus.

The invention also provides a feature wherein the suction conveyor runs at a velocity greater than the speed of production of the thin metal ribbon, causing the conveyor to slide on the ribbon, thereby imparting tension to the ribbon as it is taken away from the separation point.

This invention also provides, as will be described in further detail hereinafter, a suction conveyor comprising a conveyor belt having air passage holes for sucking and holding a thin metal ribbon on its surface, a top plate having air passage holes and a plurality of intermediary members which provide reduced area of contact between the top plate and the back surface of the conveyor belt, and a suction box arranged to suck air through the air passage holes so as to cause the conveyor belt back surface to contact the intermediary members.

Still another feature of the invention is a thin metal ribbon producing apparatus which can sort acceptable products from unacceptable products even during production. To this end, as further described in detail hereinafter, there is provided a first-stage suction conveyor for separating the ribbon from the quench roll and sucking the ribbon, the first-stage suction conveyor having a suction start position located adjacent the ribbon separation location on the peripheral surface of the quench roll and pivotable about a pivot shaft also disposed adjacent the separation location. This allows the downstream end of the suction conveyor to swing up and down between a ribbon take-up position and a ribbon disposal position; and a second-stage suction conveyor having an upstream end disposed near the downstream end of the first-stage suction conveyor when the downstream end of the first-stage suction conveyor is at the ribbon take-up position, to suck and further convey the ribbon received from the first-stage vacuum conveyor.

These and other objects of the present invention will become further apparent from the following description, and in the drawings.

DETAILED DESCRIPTION OF THE INVENTION

Figure 1:
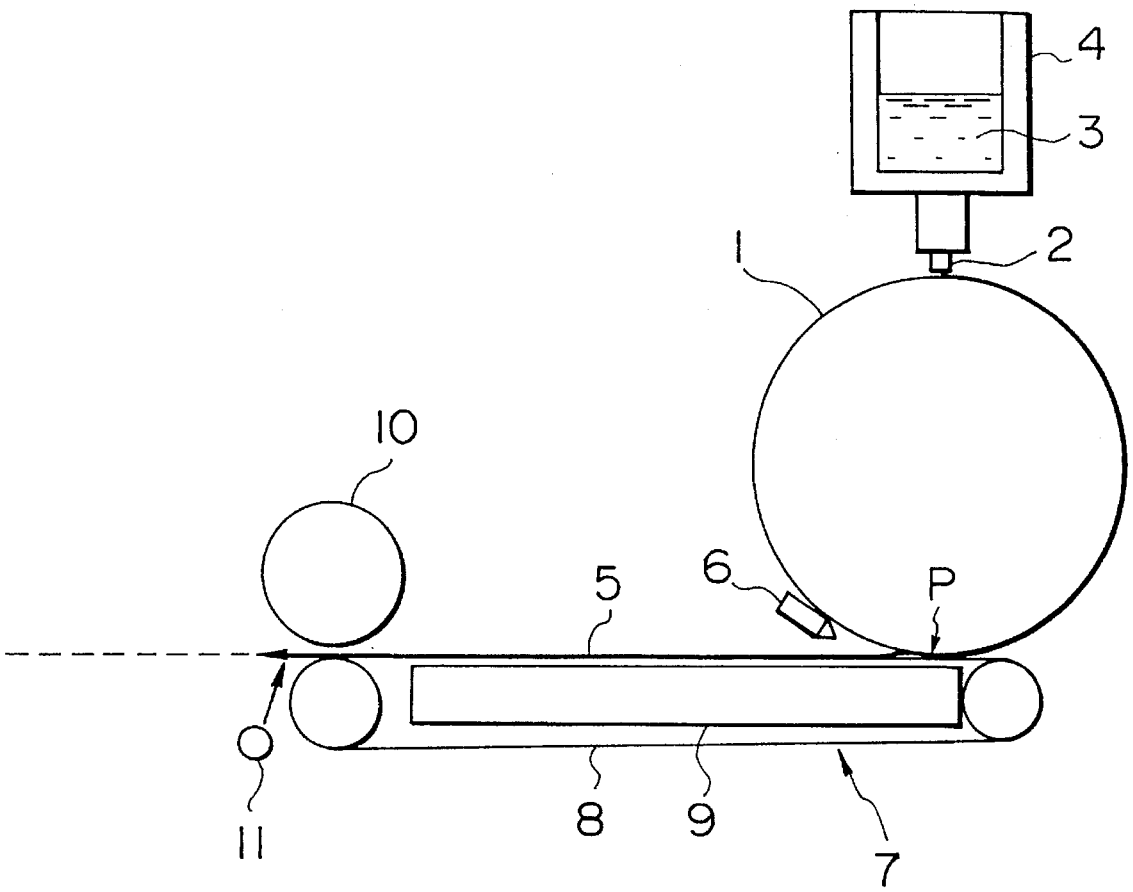
FIG. 1 is a schematic side view of an embodiment of a thin metal ribbon production apparatus suitable for use in carrying out the present invention.

In the description which follows, specific terms will be used, in the interest of clarity, in referring to the particular forms of the invention selected for illustration in the drawings. This description is not intended to define or to limit the scope of the invention, which scope is defined in the appended claims.

Referring to FIG. 1, a molten metal 3 is poured through a nozzle 2 onto a quench roll 1 which is rotated at high speed, so that the molten metal 3 is quickly cooled and solidified on the quench roll 1 to form a thin metal ribbon 5 (sometimes referred to herein simply as ribbon 5). The molten metal 3 prior to being poured is stored in a tundish 4.

An air slit nozzle 6 is provided which has a slit-like opening for blowing or jetting air in a direction toward the separation location or point P so as to separate the thin metal ribbon 5 from the quench roll 1. The ribbon 5 is then concurrently attracted and caught by the neighboring end of a suction conveyor 7 which is disposed. immediately under the separation point P. Numeral 9 denotes a suction box for generating negative pressure. The ribbon 5, while sucked by and fixed to the conveyor 7, is moved together with a belt 8 of the conveyor 7 without being damaged and is delivered to a take-up reel 10 disposed at the downstream end of the suction conveyor 7. The ribbon 5 is then coiled onto the take-up reel 10 by the action of a pressing roll 11.

The take-up reel 10 is provided with an adhesive material on its peripheral surface. The take-up reel 10 is rotated in synchronization with the rate of production of the ribbon 5, so that the ribbon 5 clings to the take-up reel 10 as soon as it makes contact.

Once the take-up by the take-up reel 10 becomes effective, the sucking operation of the suction conveyor 7 and the rotation of the belt 8 may be stopped.

When a device such as a measuring instrument needs to be placed between the quench roll 1 and the take-up reel 10 at H position where it may interfere with the suction conveyor 7, it is possible to arrange for retraction of conveyor 7 by a suitable retracting device.

Figure 2:
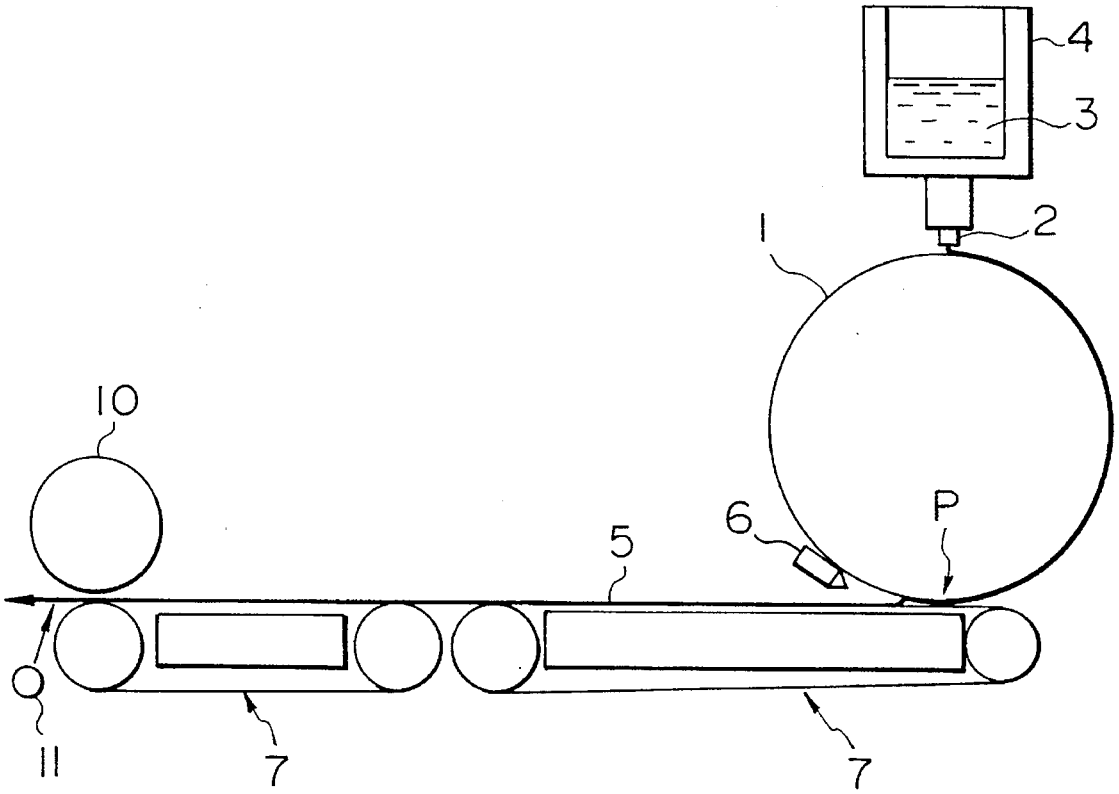
FIG. 2 is a schematic side view of another embodiment of the present invention.

When the take-up reel 10 is spaced far away from the quench roll 1, it is possible to use two or more sets of suction conveyors 7 in a series or tandem manner as illustrated in FIG. 2.

Figure 3:
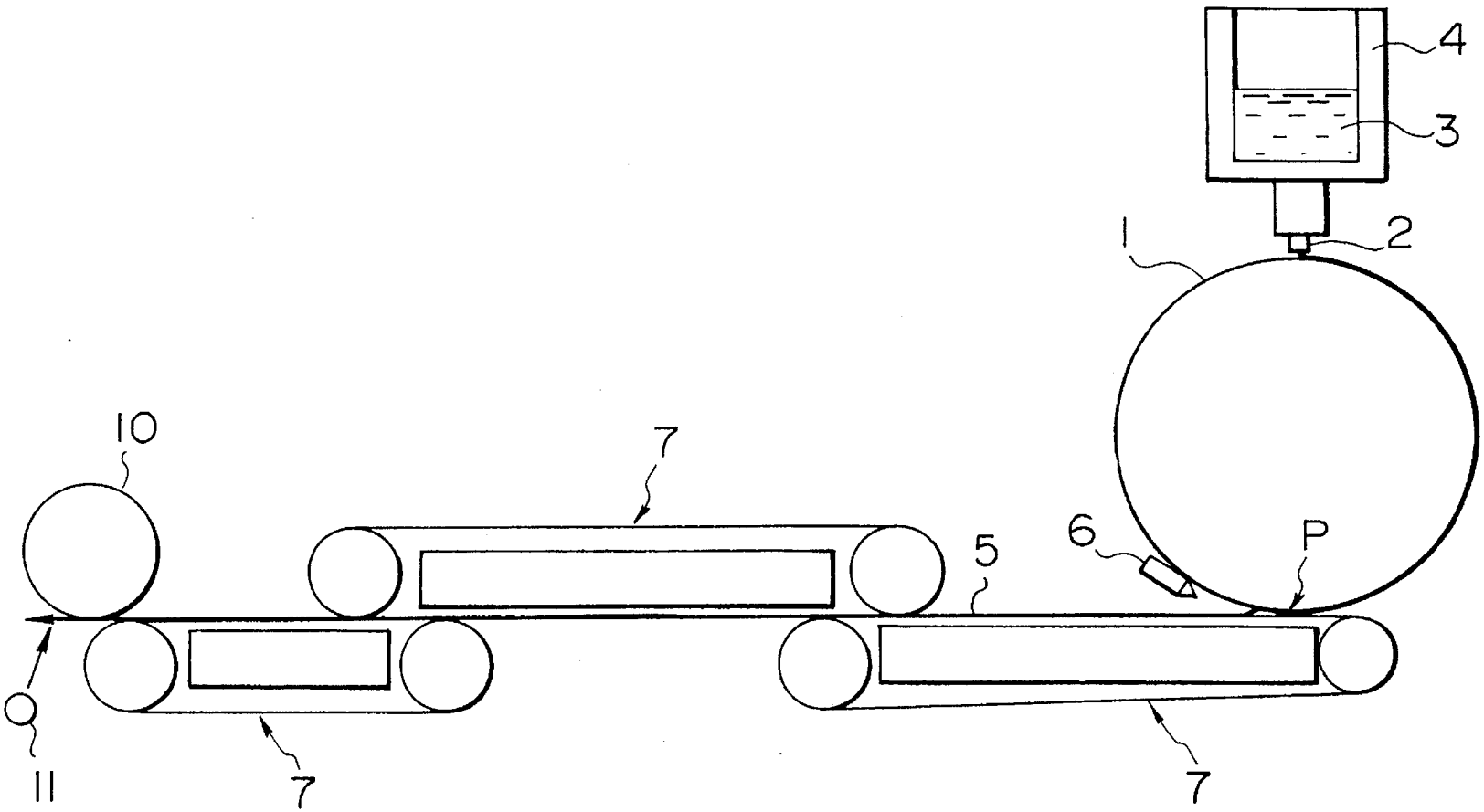
FIG. 3 is a schematic illustration of a further embodiment of the present invention.

FIG. 3 shows a modification in which a plurality of conveyors 7 are arranged in a vertically staggered manner to facilitate delivery of the ribbon 5 between the conveyors 7, 7, 7 or to enable retraction of any one or more of the conveyors.

Winding the thin metal ribbon on the take-up reel may be done in many different Ways. For instance, it is possible to use a take-up reel which is provided with magnets attached to the barrel thereof. In such a case, the take-up reel may be moved to a position close to the quench roll so as to catch the separated thin metal ribbon. Alternatively, the end of the thin metal ribbon may be brought into contact with a take-up reel having magnets by the action of a suitable pressing means or by tilting the final stage of the conveyor.

Figure 4:
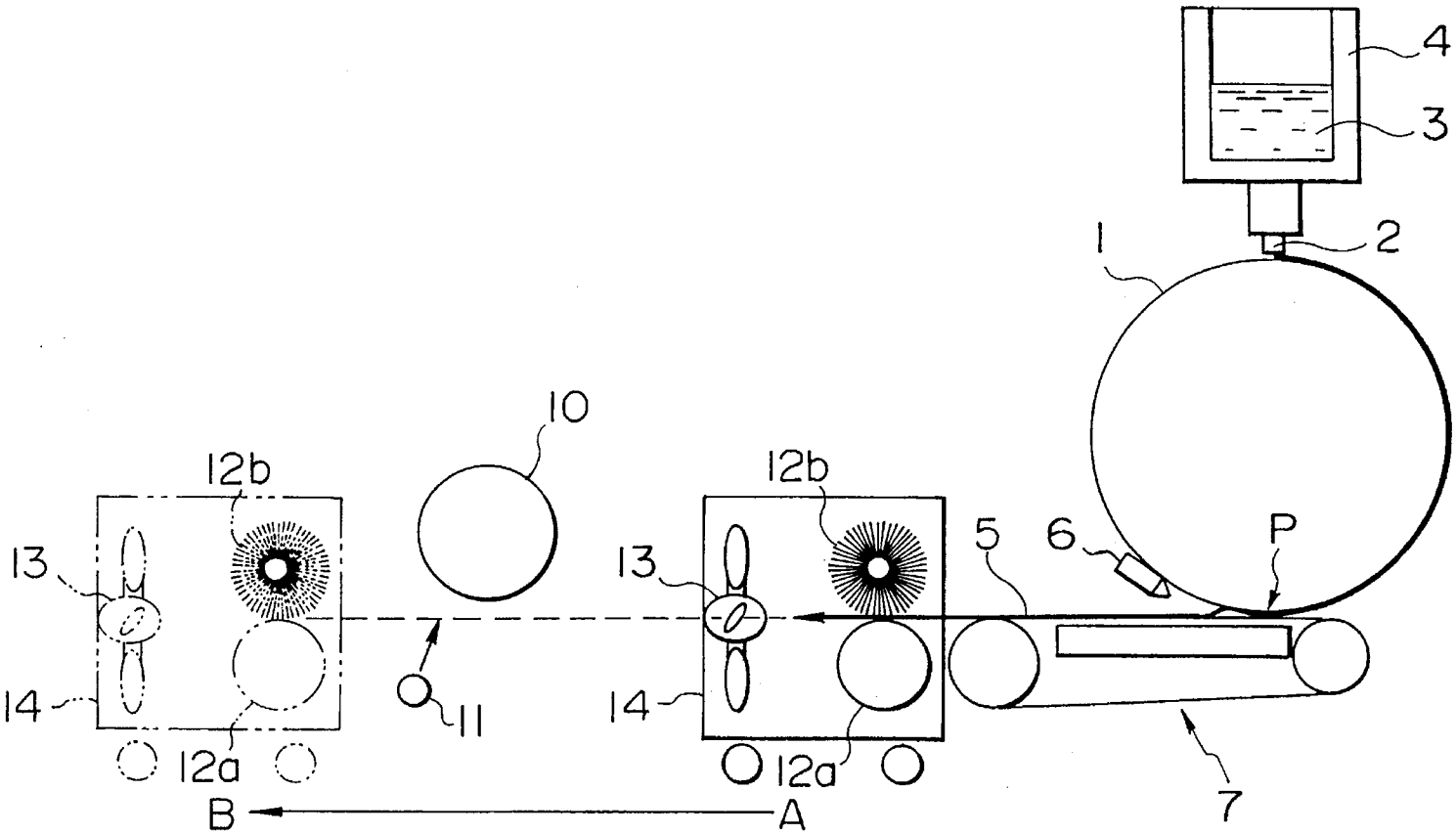
FIGS. 4, 5, 6 and 7 are schematic side views of still further embodiments of the present invention.

FIG. 4 shows a further embodiment in which the ribbon 5 separated from the quench roll 1 is sucked by the suction conveyor 7 and caught by a pair of pinch rolls 12*a*, 12*b* disposed at the downstream end of the suction conveyor 7. The pinch rolls 12*a*, 12*b* deliver the ribbon 5 to the take-up reel 10. In FIG. 4, numeral 14 denotes a truck which caries the pinch rolls 12*a*, 12*b* and a suction blower 13 between positions A and B in FIG. 4. The leading end of the ribbon 5 which has been conveyed to the downstream end of the suction conveyor 7 is suspended by air flow generated by the suction blower 13 so as to be moved to a pat line between the downstream end of the suction conveyor 7 and the pinch rolls 12*a*, 12*b* on the truck 14, so as to be guided into the nip between these pinch rolls 12*a*, 12*b*.

As the ribbon 5 is pinched between the pinch rolls 12*a*, 12*b*, an adequate level of tension is applied to the ribbon 5 as a result of rotation of pinch rolls 12*a*, 12*b*.

Then, while the leading end of the ribbon 5 continuously fed is broken by the suction blower 13, the truck 14 is moved from a position A to a position B shown in FIG. 4, so that the end of the ribbon 5 is transferred to the take-up reel 10 so as to be coiled on the latter.

In a preferred form, one of the pinch rolls 12*a* is a smooth roll while the other pinch roll 12*b* is a brush roll, and the speed of rotation of the pinch rolls 12*a*, 12*b* or the force at which the ribbon 5 is pressed onto the smooth roll 12*a* is adjusted so as to optimize the level of the tension applied to the ribbon 5.

In FIG. 4, the brush roll 12*b* is disposed on the upper surface of the solid roll 12*b* but the arrangement may be reversed. It is also possible to employ two or more pairs of pinch rolls to improve gripping of the ribbon 5 if necessary or desirable.

According to the embodiments of the present invention shown in FIGS. 1–4, compressed gas is jetted from the air nozzle 6 onto a point on the quench roll 1, preferably tangentially thereto to separate the ribbon 5 from the quench roll 1, and the ribbon 5 is sucked and caught by the belt of a suction conveyor 7 which is disposed in the vicinity of the designated ribbon separation point, so that the ribbon 5 can be conveyed continuously in accordance with the rotation of the belt of the conveyor 7. It is therefore possible to develop a uniform breadthwise distribution of tension on the ribbon 5 and to fix the separation point steadily at a predetermined position.

The ribbon 5 on the suction conveyor 7 is conveyed while being sucked and held on the conveyor to the downstream end of the latter, so that there is no risk that the ribbon 5 might be wrinkled, bent or otherwise damaged during conveyance.

When a plurality of conveyors 7 are used in series, it is possible to convey the leading end of the ribbon 5 to the region near the take-up reel 10 without causing fluttering of the ribbon 5 at the transient zone between successive conveyors.

Thus, the ribbon 5 can be conveyed stably and securely by virtue of the suction conveyor 7, so that it can easily be wound on the take-up reel 10 which is rotating in synchronization with the speed of production of the ribbon 5.

When pinch rolls are used in the path of conveyance at the downstream end of the suction conveyor 7, the pinch rolls can nip the leading end of the ribbon 5 without flutter.

Furthermore,in the event of failure in the winding of the ribbon 5 on the take-up reel 10, it is possible to substitute another take-up reel or to try the winding again on the same take-up reel after a readjustment of the latter.

Reference will now be made to illustrative examples of runs made with the embodiments of the invention heretofore described.

EXAMPLE 1

A thin metal ribbon 5 was produced by using the apparatus shown in FIG. 1. A molten alloy containing 1 at % of C, 9 at % of Si, 10 at % of B ("at" means atomic) and the balance substantially Fe was held at 1300° C. and was injected through a nozzle 2 having a slit opening of 50 to 200 mm wide onto the peripheral surface of a quench roll 1 of a copper alloy rotating at a high peripheral sped (25 m/s), whereby a ribbon 25 μm thick was obtained.

Then, air was blown at a velocity of 40 m/sec through the air slit nozzle 6 so as to separate the ribbon 5 from the quench roll 1 at the separating pint P and the leading end of the ribbon 5 thus separated was caught by the upstream end of the suction conveyor 7 disposed immediately under the separation point P at an attracting force of 0.5 to 2.0 kgf per 100 $cm^2$.

The ribbon 5, while being sucked by the suction conveyor, was moved together with the belt 8 of the conveyor 7 to a region near the take-up reel 10 located at the downstream end of the suction conveyor 7, and was wound on the take-up reel 10 by the action of the press roll 11.

Throughout the operation the separating point P was steadily fixed and the ribbon 5 was separated stably. The separated ribbon 5 was conveyed without wrinkle, bend or fluttering and was easily wound on the take-up reel 10.

EXAMPLE 2

Production of the ribbon 5 was conducted using the apparatus shown in FIG. 4 under the same conditions as Example 1.

Then, air was blown at a velocity of 40 m/sec through the air slit nozzle 6 so as to separate the ribbon 5 from the quench roll 1 at the separating point P and the leading end of the ribbon 5 thus separated was caught by the upstream end of the suction conveyor 7 disposed immediately under the separation point P at an attracting force of 0.5 to 2.0 kgf per 100 $cm^2$.

The ribbon 5, while being sucked on the suction conveyor, was moved together with the belt 8 of the conveyor 7. Meanwhile the suction blower 13 was activated to generate an air flow of 25 m/s or higher velocity so as to suspend and introduce the leading end of the ribbon 5 to the nip between the pinch rolls 12*a*, 12*b* located at the downstream end of the suction conveyor 7. After the leading end of the ribbon 5 was caught by the pinch rollers 12*a*, 12*b*, the truck 14 was driven to convey the pinch rolls 12*a*, 12*b* to the position of the take-up reel 10 and then the ribbon 5 was wound on the take-up reel 10 to form a coil.

Throughout the operation the separating point P was steadily fixed and the ribbon 5 was separated stably. The separated ribbon 5 was conveyed without wrinkle, bend or fluttering and, hence, was easily caught by the pinch rollers 12*a*, 12*b*

The position of the separating point at which the thin metal ribbon leaves the quench roll is stably fixed because the leading end of the freed thin metal ribbon is sucked and caught by the upstream end of the suction conveyor which is disposed immediately downstream of the separation point, thus greatly reducing the risk of damaging of the thin metal ribbon which hitherto was often experienced due to fluttering of the ribbon, while realizing stable take-up and coiling of the thin metal ribbon.

Figure 5:
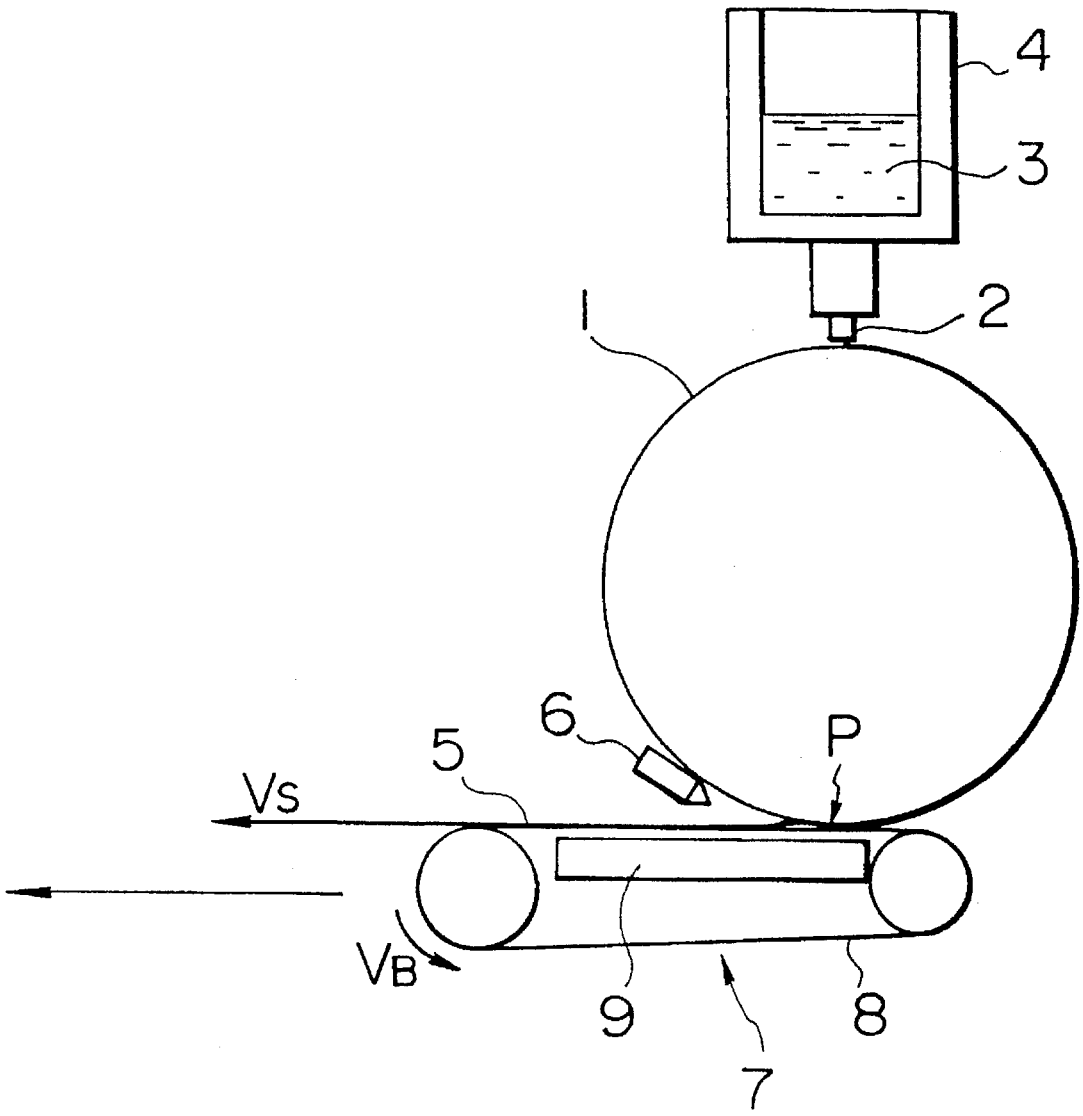
Figure 6:
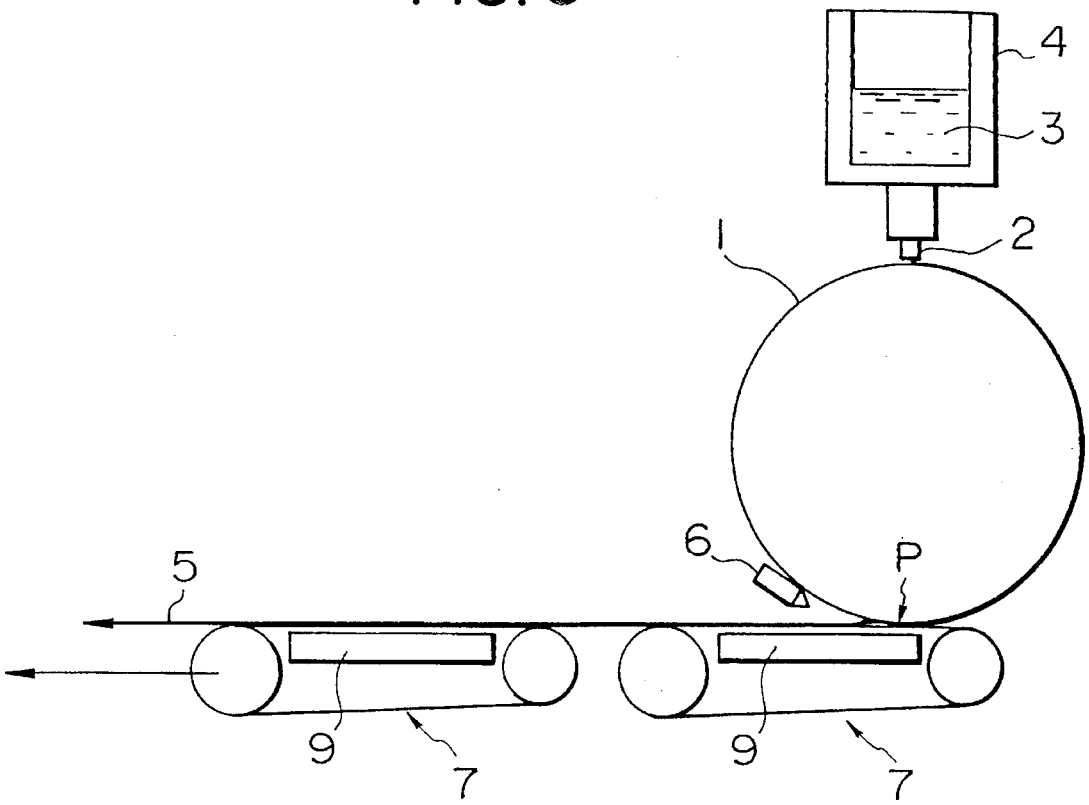
Figure 7:
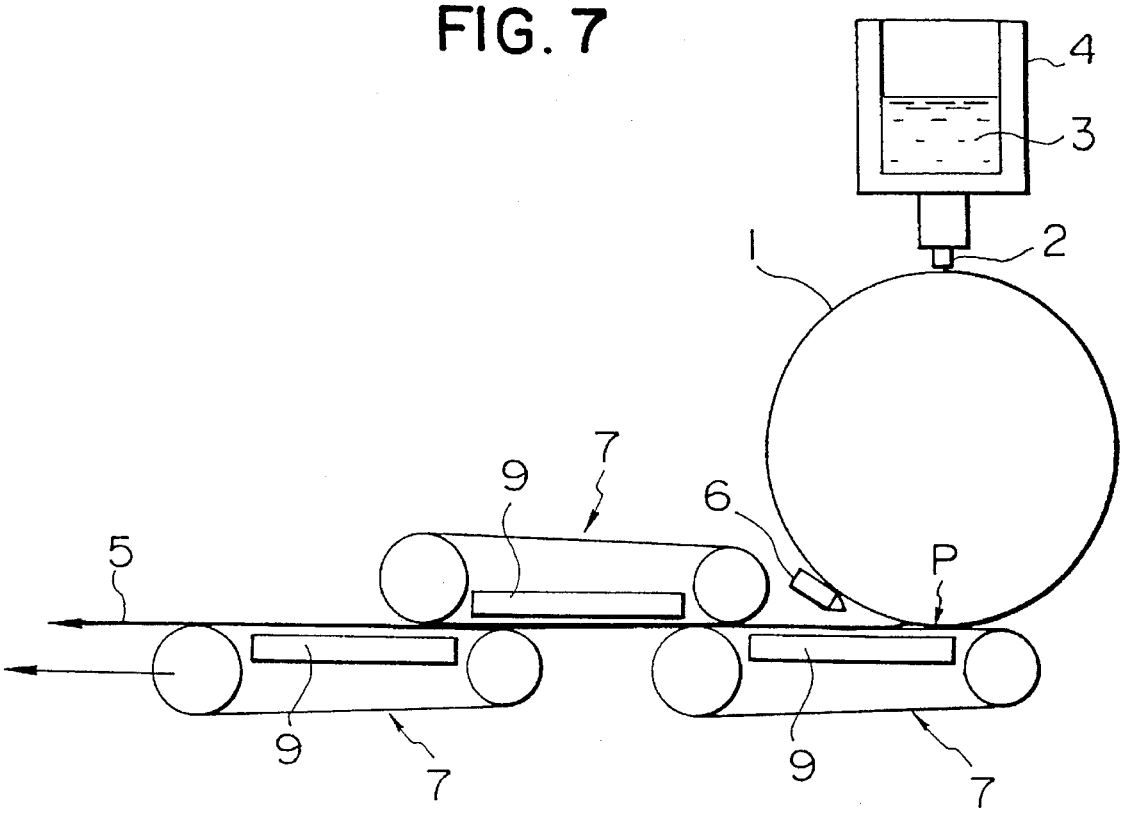

FIG. 5 shows another embodiment wherein a molten metal 3 is poured through a nozzle 2 onto a quench roll 1 rotating at a high speed, as heretofore described. While the ribbon 5 is sucked by and fixed to the conveyor 7, the conveyor 7 is moved by a suitable transport device (such as a truck 14 of FIG. 4 carrying the conveyor 7 as heretofore described) to bring the downstream end of the suction conveyor 7 to a take-up reel.

In FIG. 5, it is important that, after the leading end of the ribbon 5 is sucked by the upstream end of the belt 8, the belt 8 is driven at a velocity VB which exceeds the velocity at which the ribbon 5 leaves the quench roll 1. This causes the belt 8 to slip on the ribbon 5 thereby imparting tension to the ribbon 5. It is also preferred that the tension applied to the ribbon 5 is controlled also by adjusting the vacuum generated in the suction box 9.

The ribbon 5 is separated from the quench roll 1, and the ribbon 5 immediately after the separation is sucked and caught on the belt of the suction conveyor 7 which is rotated to continuously convey the ribbon 5, so that it is possible to develop a uniform breadthwise distribution of the tension on the ribbon 5 and to fix the separation point steadily at a predetermined position.

The ribbon 5 on the suction conveyor 7 is conveyed while being sucked and held on the conveyor to the downstream end of the latter, so that there is no risk for the ribbon 5 to be wrinkled, bent or otherwise damaged during conveyance.

In addition, the belt 8 of the conveyor is rotated at a velocity exceeding that of the ribbon 5 coming from the quench roll 1 so as to adequately tension the ribbon 5 both in the longitudinal and breadthwise directions, thus achieving safe conveyance of the ribbon 5 without damage.

Thus, the ribbon 5 can be conveyed stably and securely by virtue of the suction conveyor 7, so that it can easily be wound on the take-up reel 10 which is rotated in synchronization with the speed of production of the ribbon 5.

The speed of rotation of the belt should preferably exceed the speed of production of the thin metal ribbon. The speed difference need not be very large provided that the required level of tension is obtained. It is preferred that the speed of rotation of the belt is greater than the speed of production of the ribbon through the entire period of conveyance from the sucking of the ribbon by the conveyor until the winding on the reel.

EXAMPLE 3

A thin metal ribbon 5 was produced by using the apparatus shown in FIG. 5. A molten alloy containing 1 at % of C, 9 at % of Si, 10 at % of B and the balance substantially Fe was held at 1300° C. and was injected through a nozzle 2 having a slit opening of 50 to 200 mm wide onto the peripheral surface of a quench roll 1 of a copper alloy rotating at a high peripheral sped (25 m/s), whereby a ribbon 25 μm thick was obtained.

Then, air was blown at a velocity of 40 m/sec through the air slit nozzle 6 so as to separate the ribbon 5 from the quench roll 1 at the separating pint P and the leading end of the ribbon 5 thus separated was caught by the upstream end of the belt 8 of the suction conveyor 7 disposed immediately under the separation point P at an attracting force of 0.5 to 2.0 kgf per 100 $cm^2$ produced by a suction box 9 1 meter long.

While the ribbon 5 was held by suction on the belt 8 of the suction conveyor 7, the belt 8 was driven at a velocity $V_B$ of 30 m/s. Meanwhile, the suction conveyor 7 was conveyed at a velocity of 1 m/s to the take-up reel which was spaced apart 10 meters from the quench roll 1.

Throughout the operation the separated ribbon 5 was conveyed without wrinkle, bend or fluttering and was easily wound on the take-up reel.

It is important that the position of the separation point at which the thin metal ribbon leaves the quench roll is stably fixed because the leading end of the freed thin metal ribbon is sucked and caught by the upstream end of the suction conveyor which is disposed immediately under the separation point, thus greatly reducing the risk of damaging the thin metal ribbon which hitherto was often experienced due to fluttering of the ribbon, while realizing stable take-up and coiling of the thin metal ribbon.

Basically, the suction conveyor suitably used in the present invention has an air-permeable conveyor belt held by two or three pulleys and a suction box disposed inside the belt so as to suck air across the conveyor belt.

In operation, the suction box sucks air through the belt so that the thin metal ribbon carried by the belt is trapped on the belt so as to be conveyed by the belt as the belt runs.

In some of the known conveyors, the belt is required to slide in contact with the entire surface of the top plate of the suction box. Consequently a large belt driving force is required to overcome frictional resistance caused between the conveyor belt and the top plate of the suction box. In addition, the conveyor belt is heavily worn down.

In view of this problem, the present invention provides a suction conveyor which can be driven by significantly less power than known conveyors and with reduced degradation of the conveyor belt.

Figure 8:
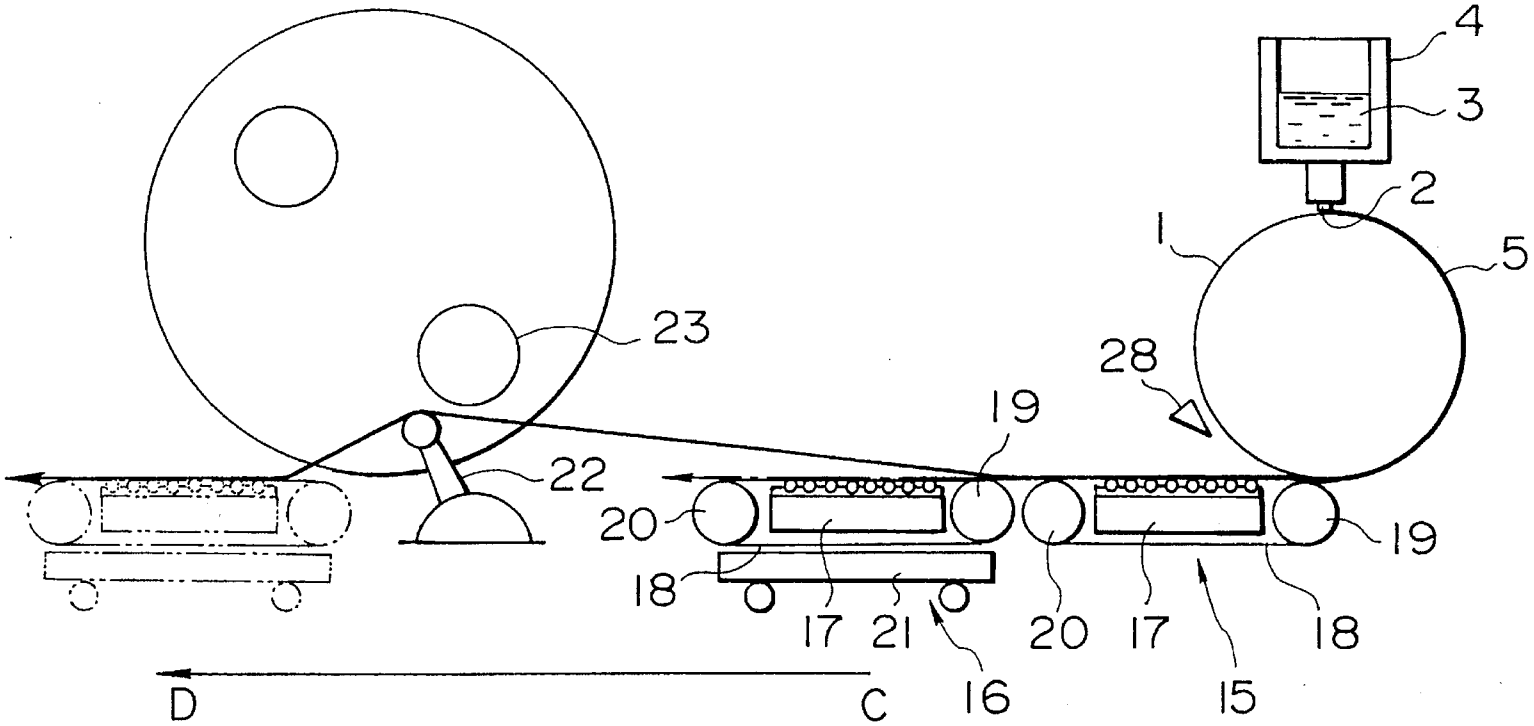
FIG. 8 is a schematic illustration of a thin metal ribbon production apparatus incorporating a suction conveyor in accordance with the present invention.

FIG. 8 is a schematic illustration of a thin metal ribbon production apparatus using a suction conveyor according to this embodiment, in which like numbers are used to denote components already described.

A first-stage suction conveyor 15 is used for conveying thin metal ribbon 5, and a second-stage suction conveyor 16 is arranged downstream of the first-stage suction conveyor 15.

The first-stage suction conveyor 15 employs a belt 18 having numerous air passage holes (not shown) and wound around pulleys 19 and 20 and a suction box 17 is disposed inside the loop of the belt 18.

The second-stage suction conveyor 16 has an upstream end which is disposed in the vicinity of the downstream end of the first-stage suction conveyor 15 so as to receive the ribbon 5.

As is the case of the first-stage suction conveyor 15, the second-stage suction conveyor 16 has a belt 18 having numerous air passage holes (not shown) and wound around pulleys 19 and 20 so as to run between these pulleys, and a suction box 17 disposed inside the loop of the belt 18. In addition, the second-stage suction conveyor 16 is carried by a truck 21 so as to be transported from a position C to a position D indicated by broken lines in FIG. 8.

In the production of the thin metal ribbon 5, the molten metal 3 is jetted through the nozzle 2 onto the peripheral surface of the quench roll 1 rotating at a high peripheral speed of 20 to 40 m/sec so that the molten metal 3 is rapidly cooled and solidified to form the thin metal ribbon 5.

Compressed air is blown (as heretofore described) from an air slit nozzle 6 arranged in the vicinity of the peripheral surface of he quench roll 1 so a to wedge into the nip between the quench roll 1 and the ribbon 5 and the ribbon 5 is sucked and caught by the first-stage suction conveyor 15 so as to be separated from the quench roll 1 and conveyed by the first-stage suction conveyor 15. This suction is effected by the suction box 17 which sucks air through the air passage holes formed in the belt 18. It is therefore easy to fix the ribbon separation point.

The leading end of the ribbon 5, conveyed to the downstream end of the first-stage suction conveyor 15, is transferred to the second-stage suction conveyor 16 and is moved by the latter from the position C to the broken-line position D to be wound on take-up reel 23 by winding device 22.

The construction of the second-stage suction conveyor 16 is materially the same as that of the first-stage suction conveyor 15.

Figure 9A:
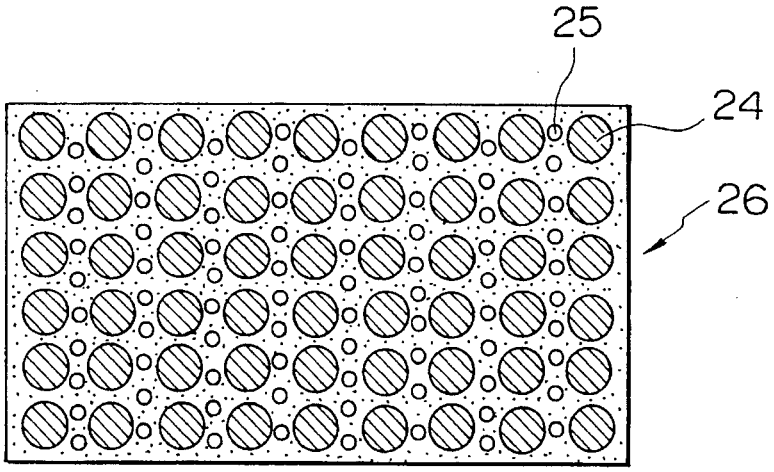
FIG. 9A is a plan view of a top plate of a first suction conveyor 17 shown in FIG. 8.
Figure 9B:
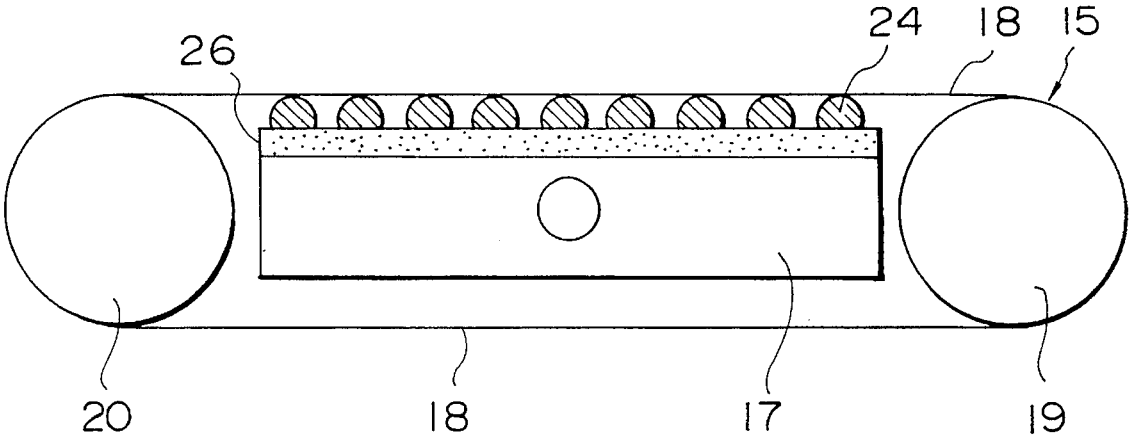
FIG. 9B is a side elevational view of the first suction conveyor 17 shown in FIGS. 8 and 9A.

As will be seen from FIGS. 9A and 9B, the first-stage suction conveyor 15 has a conveyor belt 18 having a multiplicity of air passages (not shown) formed therein so as to suck and fix the thin metal ribbon onto the upper surface thereof, and a top plate 26 having a multiplicity of air passage holes 25 (FIG. 9A) and provided with a multiplicity of hard bearings or balls 24 which are partly embedded in the upper surface thereof for smooth sliding contact with the back surface of the conveyor belt 18. The first-stage suction conveyor 15 further has a suction box 17 which is disposed in the loop of the conveyor belt 18 which sucks air through the air passages 25 so as to keep the back surface of the conveyor 18 in sliding contact with the hard balls 24.

Although not shown, sealing walls are provided to seal in an airtight manner the space defined between the top plate 26 and the conveyor belt 18 so that the conveyor belt 18 can more efficiently contact the hard balls 24.

In the first-stage suction conveyor 15, the back surface of the conveyor belt 18 smoothly slides on the hard balls 24 and, in addition, the area of frictional sliding contact is reduced as compared with known conveyors in which the conveyor belt 18 contacts the entire surface of the top plate 26.

In operation of this conveyor its driving power was reduced to about ½ that required in conventional conveyors. The life of the belt was extended about double that of conventional conveyors.

Figure 10A:
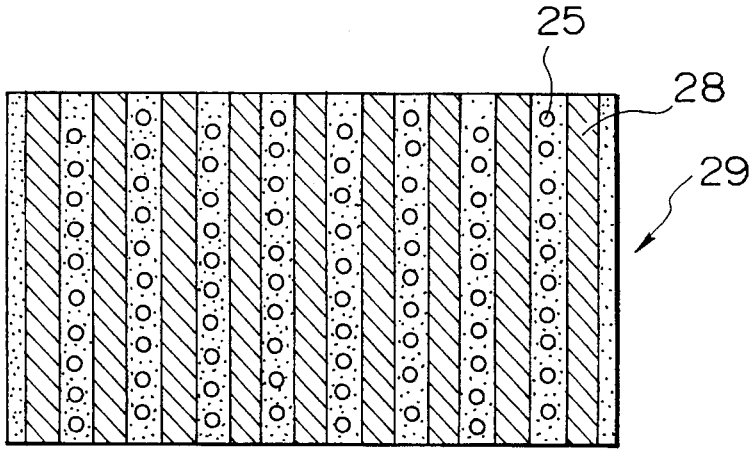
FIG. 10A is a plan view of a top plate of another form of suction conveyor.
Figure 10B:
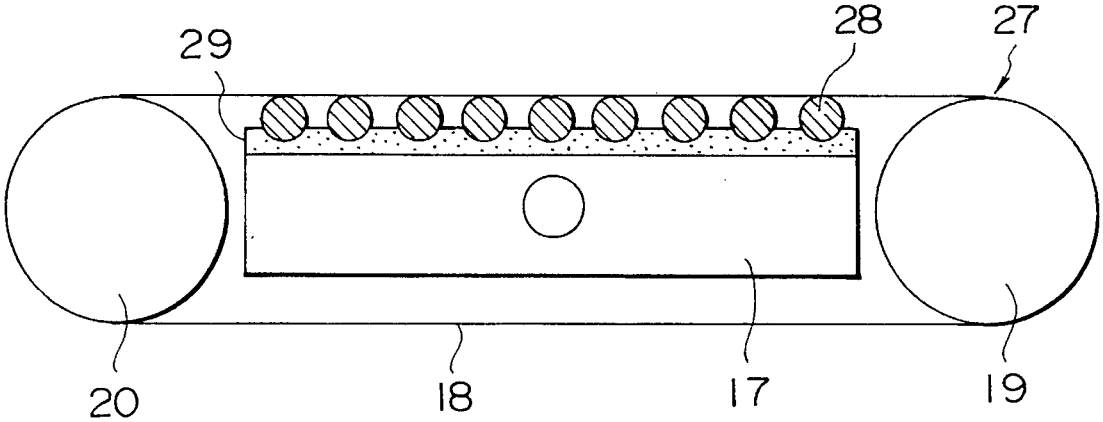
FIG. 10B is a side elevational view of a first suction vacuum conveyor in accordance with this invention.

The suction conveyor of FIGS. 10A and 10B differs from the conveyor shown in FIGS. 9A and 9B only in that round bars 28 are embedded in place of the hard balls 24 shown in FIG. 9A.

Although in the embodiments shown in FIGS. 9A to 10A employ hard balls or round bars fixedly embedded in the top plate, the arrangement may be such that the hard balls or the round bars are rotatably received in recesses formed in the upper surface of the top plate to realize a bearing-like structure.

Although the suction conveyor has been described as being suitable for catching and conveying a thin metal ribbon, it is to be understood that the suction conveyor in accordance with the invention can be used for conveying other types of products.

In producing a thin metal ribbon by pouring a molten metal onto a quench rolls a problem is encountered in that the quality of the product is not always stable throughout the beginning of production immediately after start up. Consequently, unacceptable ribbon may be produced during such period.

In view of this problem, Japanese Patent laid-Open No. 2-55647 discloses a process in which an unacceptable portion of thin metal ribbon is directed to a zone which is different from the zone where the take-up reel is provided. This employs a trough-like guide which is movable to switch the path of delivery so as to sort unacceptable product immediately after the start of production and, once the operation is stabilized to produce acceptable product, to direct such acceptable product toward the take-up reel.

In the meantime, the present applicant has proposed, in Japanese patent laid-open No. 4-340569, a technique for fractioning and separating unacceptable portions of the thin metal ribbon by a combination of a suction conveyor and a ribbon fractioning blower connected to the conveyor.

In some cases, however, unacceptable product appears not only at the beginning of the operation but also in the course of steady operation. Therefore, whenever the product quality is degraded to an unacceptable level, the unacceptable portion should be sorted out. It is also necessary that, in the event of accidental cutting of the ribbon during production, the portion of the ribbon downstream of the cut point should be conveyed to the take-up reel.

The known art, however, suffers from problems which impede stable production of thin metal ribbons.

The art disclosed in Japanese Patent Laid-Open No. 2-55647 employs a trough-like guide for guiding the thin metal ribbon separated from the quench roll towards the take-up reel. However, it is not easy to stably guide the separated thin metal ribbon to the take-up reel by the trough-like guide which is spaced from the quench roll, because the separation point at which the thin metal ribbon leaves the quench roll shifts from time to time. In addition, the trough-like guide, although it may be able to guide the thin metal ribbon to the take-up reel, has no function to relax the tension which is abruptly applied to the thin metal ribbon when the ribbon is wound on the reel. This makes it extremely difficult to safely start the winding of the thin metal ribbon on the take-up reel. Furthermore, this known art sometimes produces unacceptable product or cutting of the thin metal ribbon and has no function to sort out the unacceptable part nor for conducting again the winding of the new portion of the ribbon after steady operation has commenced.

The combination of the suction conveyor and fractioning blower as proposed by the present applicant also is not able to conduct sorting out of unacceptable portions of the product and winding the new portion of the product ribbon after cutting in the course of steady operation of the apparatus, although it can perform sorting out of unacceptable parts of the product and delivery of the acceptable part of the product in the beginning transient period immediately after the start of the production.

Accordingly, this invention is aimed at providing a thin metal ribbon producing apparatus which is capable of continuously taking up and coiling a thin metal ribbon and sorting out unacceptable portions of the product even during steady operation of the production apparatus.

Figure 11:
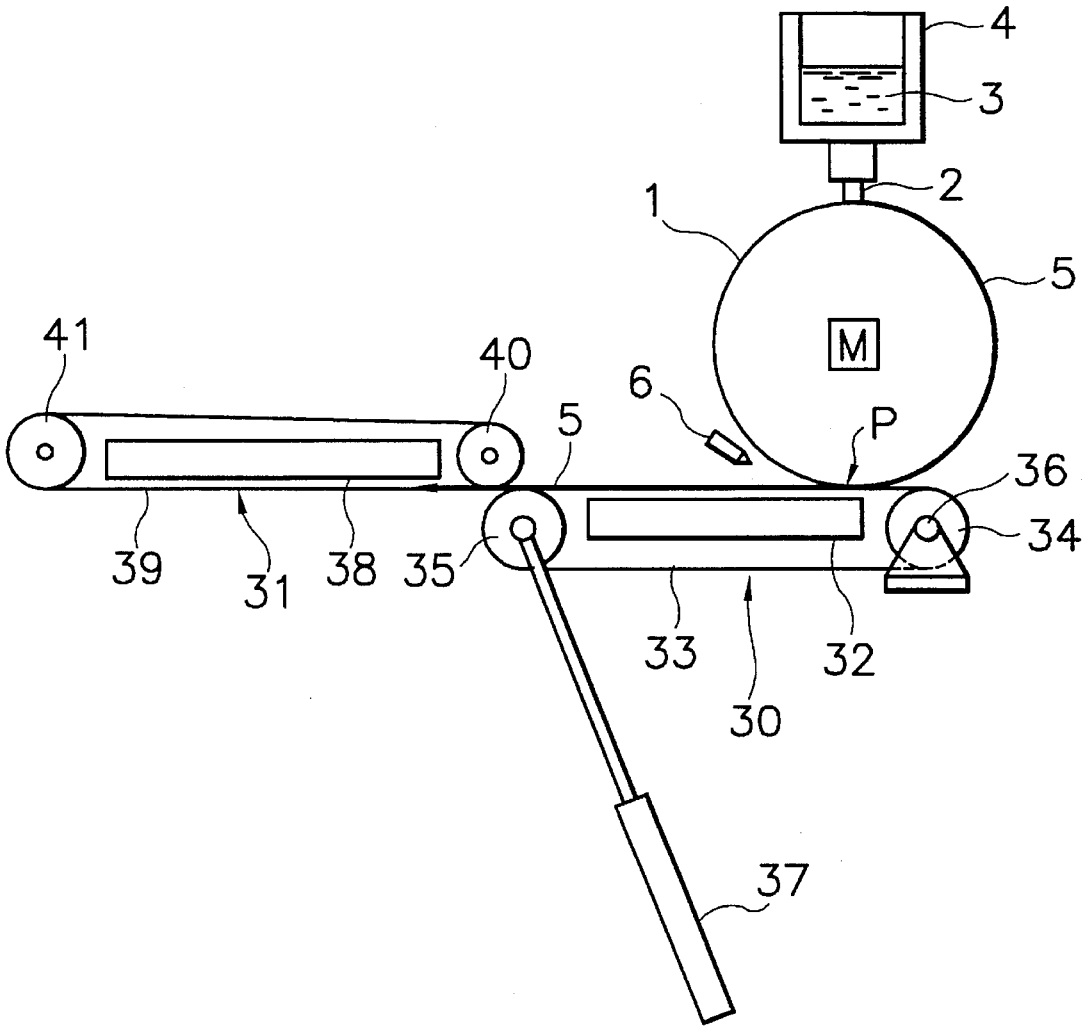
FIG. 11 is a schematic side view of an embodiment of the present invention, in which the trailing end of a first suction conveyor is positioned at a metal ribbon take-up position.
Figure 12:
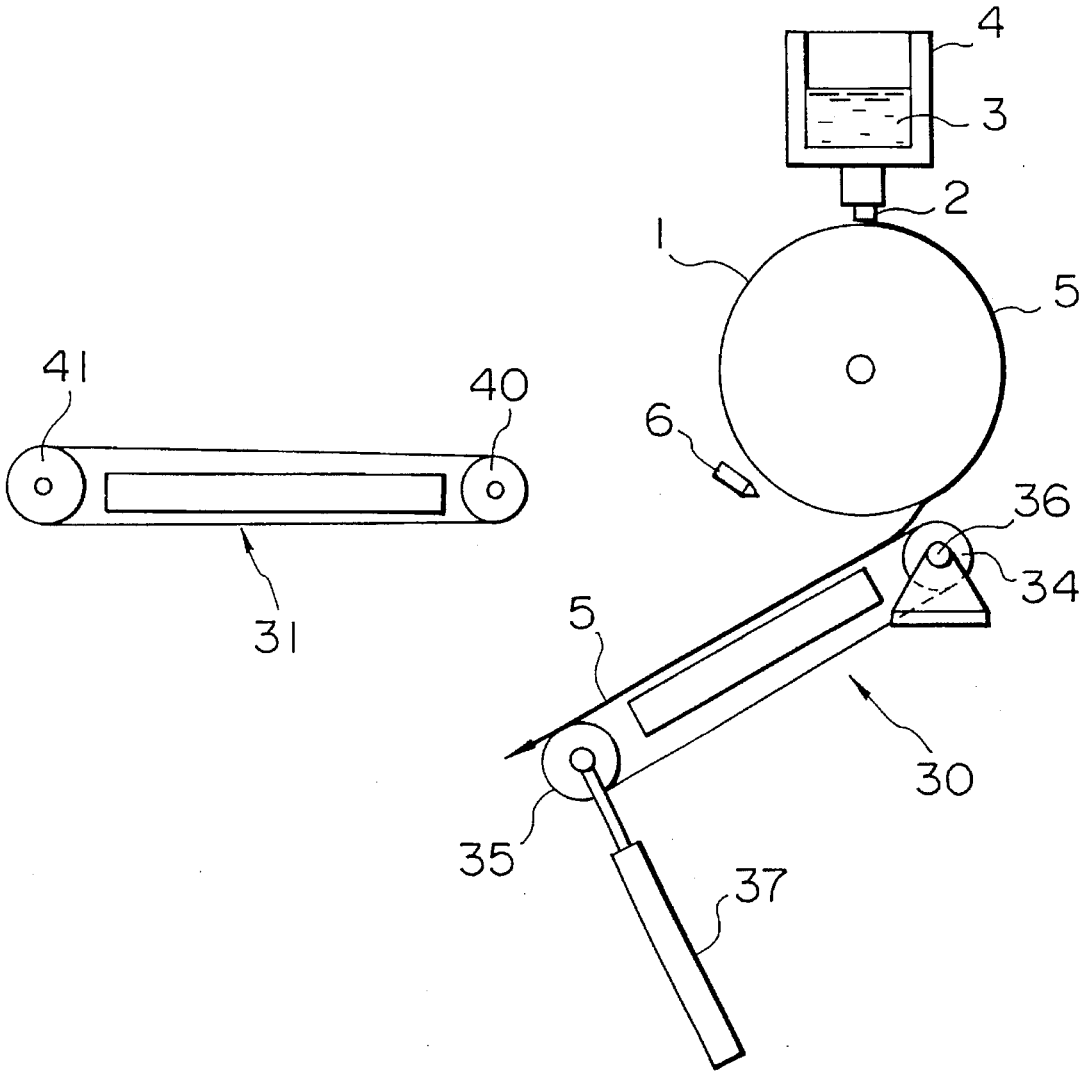
FIG. 12 a schematic side view of the thin metal ribbon production apparatus of FIG. 11.

FIG. 11 is a schematic illustration of an embodiment of thin metal ribbon production apparatus in which the downstream end of the first-stage suction conveyor is disposed in a ribbon take-up position, while FIG. 12 shows the same apparatus in which the trailing end of the first-stage suction conveyor is arranged in a ribbon disposal position.

The thin metal ribbon production apparatus includes first-stage suction conveyor 30 for conveying the product thin metal ribbon 5 and a second-stage suction conveyor 31 connected to the first-stage suction conveyor 30.

The suction start position of the first-stage suction conveyor 30 is disposed in close proximity to the periphery of the quench roll 1. The first-stage suction conveyor 30 has a belt 33 having a multiplicity of air passage holes and wound around pulleys 34, 35. The conveyor 30 also has a suction box 32 disposed inside the loop of the belt 33.

The first-stage suction conveyor 30 is pivotable about a pivot shaft 36 which is at the end of the conveyor near the suction start position, P, by the action of a cylinder 37, such that the downstream end of this conveyor 30 can be swung between a ribbon take-up position (shown in FIG. 11) and a downwardly-directed ribbon disposal position (shown in FIG. 12).

The upstream end of the second-stage suction conveyor 31 is disposed in close proximity to the downstream end of the first-stage suction conveyor 30 when the latter is in the ribbon take-up position, so that the thin metal ribbon 5 which has been conveyed by the first-stage suction conveyor is safely received by the second-stage suction conveyor 31.

The second-stage suction conveyor 30 has a construction similar to the first-stage suction conveyor 30: namely, it has a belt 39 having a multiplicity of air passage holes and wound around pulleys 40, 41, and a suction box 38 disposed in the loop of the belt 39.

In operation, the molten metal 3 is poured through the nozzle 2 onto the outer peripheral surface of the quench roll 1 which is rotated at a speed of 20 to 30 m/s, by motor, M so that the molten metal 3 is rapidly cooled and solidified to form the thin metal ribbon 5.

At the same time, compressed air is jetted from the air slit nozzle 6 disposed in the vicinity of the peripheral surface of the quench roll 1 so as to wedge into the nip between the ribbon 5 and the quench roll 1, whereby the ribbon 5 is sucked by the first-stage suction conveyor 30 and separated from the quench roll 1. The suction is performed by the suction box 32 which sucks air through the air passage holes formed in the belt 33. Consequently, the ribbon 5 is effectively separated from the quench roll 1 always at a constant separation point.

The ribbon 5 which has been conveyed to the downstream end of the first-stage suction conveyor 30 is then delivered to the second-stage suction conveyor 31 and to a take-up reel as heretofore discussed.

In the event that any unacceptable portion of the ribbon 5 has been produced or accidental cutting of the ribbon 5 has occurred at any time the first-stage suction conveyor 30 is pivotally lowered to the ribbon disposal position, whereby the delivery of the thin metal ribbon to the second suction conveyor 31 is prevented.

It is therefore possible to dispose of any defective part or the ribbon or to deal with accidental cutting of the ribbon without interrupting the production of the ribbon. Then, when the quality of the product ribbon is recovered, the first suction conveyor 31 is simply pivoted upwardly to the ribbon take-up position so that a new portion of the ribbon having acceptable quality is wound on the take-up reel.

Various types of defects can occur in operation such as perforation, thickness variation and width variation of the ribbon, as well as surface defects such as generation of coarse air pockets or dents.

Such defects can be detected by visually checking or with assistance of specific detector devices arranged at suitable portions of the production line, e.g., at a position near the quench roll, near first and second suction conveyors and/or at the outlet of the second suction conveyor.

Thus, any defective portion of the product can be quickly excluded upon detection; the first suction conveyor is rotated between the take-up position and the disposal position.

Figure 13:
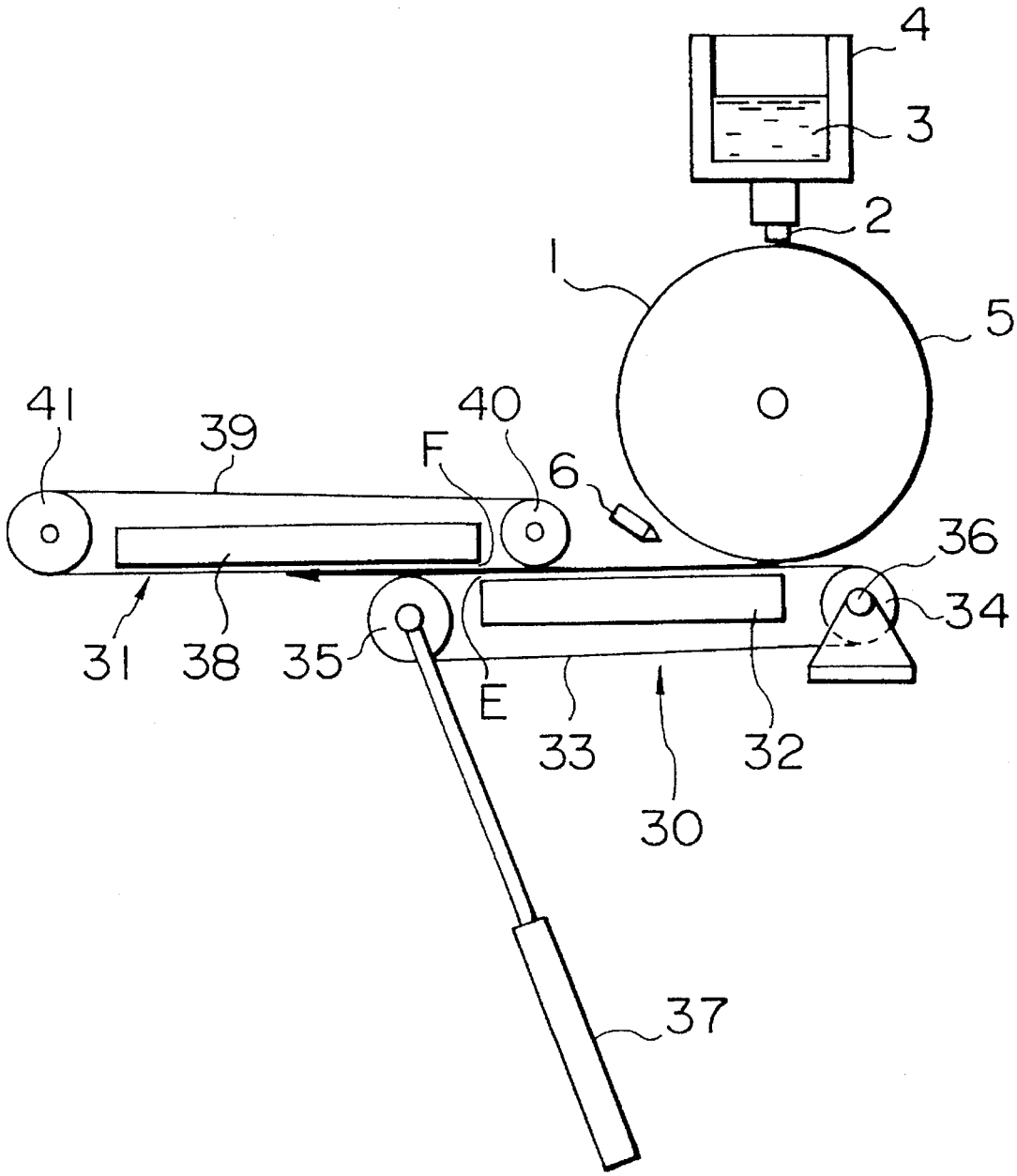
FIG. 13 is a schematic side view of another embodiment of the thin metal ribbon production apparatus in accordance with the present invention.
Figure 14:
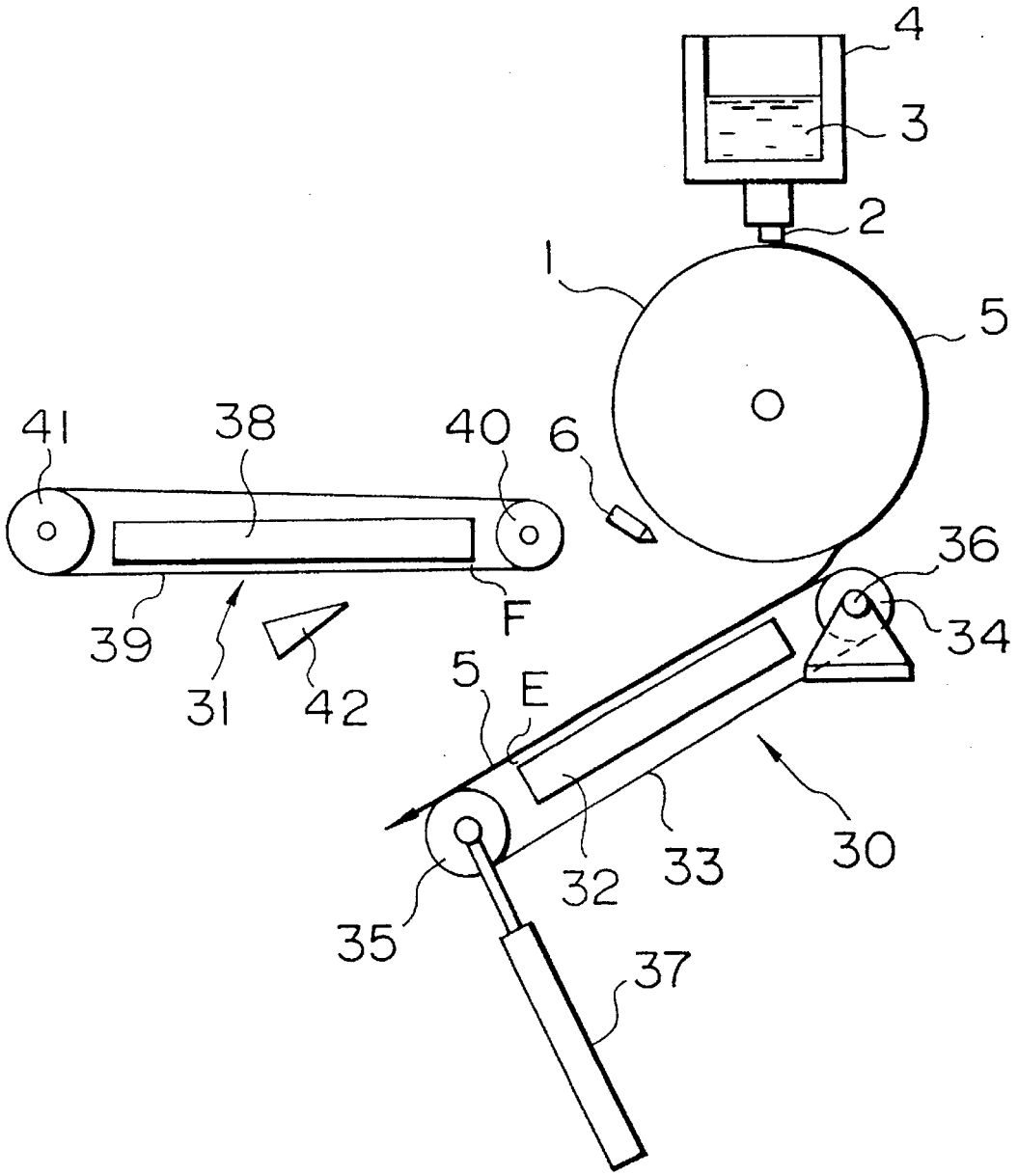
FIG. 14 is a schematic illustration of the thin metal ribbon production apparatus of FIG. 13.

FIGS. 13 and 14 show another embodiment of the present invention. FIG. 13 is a schematic illustration in which the downstream end of the first suction conveyor is disposed at the ribbon take-up position, while in FIG. 14 the downstream end of the first-stage suction conveyor is disposed at the ribbon disposal position. In these figures, the same reference numbers are used to denote the same parts or components already described.

This embodiment is characterized in that the suction start position of the second suction conveyor 31 coincides with the suction termination position of the first suction conveyor 30.

This arrangement ensures that the ribbon 5 can more securely be delivered from the first suction conveyor 30 to the second suction conveyor 31.

Further, a cutter 42 is provided for cutting the ribbon 5. It is disposed-in the vicinity of the suction start position of the second suction conveyor 31.

According to this arrangement, the ribbon 5 is cut when the first suction conveyor 30 is pivoted in the event of production of defective ribbon or accidental cutting, so that any defective portion of the ribbon 5 is sorted out without fail.

As will be understood from the foregoing description, the suction start position of the first suction conveyor is located in the vicinity of the peripheral surface of the quench roll so as to suck the thin metal ribbon. Consequently, the thin metal ribbon can be stably separated from the quench roll at a fixed separation point and can be delivered to the second suction conveyor without wrinkling, bending or fluttering.

In addition, the first suction conveyor can pivot about a pivot shaft provided on the upstream end thereof so as to swing the downstream end thereof between the ribbon take-up position and the ribbon disposal position, It is therefore possible to sort out any defective portion of the product not only in the beginning period immediately after the start-up but also in the course of steady operation of the production apparatus, and, in the event of accidental cutting of the thin metal ribbon, to convey the leading end of the new portion of the ribbon to the second-stage vacuum conveyor belt to enable commencement of winding of this portion of the ribbon on the take-up reel.

Although this invention has been described with reference to specific embodiments selected for illustration in the drawings, it will be appreciated that many other forms of apparatus and method may be used instead. For example, certain features of the invention may be used independently of others. Various velocities of air jets, conveyor speeds and other parameters may be adopted. Further, equivalent elements and method steps may be substituted and parts may be reversed, all without departing from the spirit and scope of the invention, as defined in the appended claims.

What is claimed is:

1. In method of producing a thin metal ribbon wherein the ribbon is separated and conveyed to a take-up device, the steps which comprise:

pouring a molten metal on a quench roll; rapidly cooling and solidifying the metal to form the ribbon;

blowing a compressed gas against the surface of said quench roll in a direction to separate said ribbon from said quench roll at a predetermined separation point;

suction conveying said ribbon from said separation point; and conveying said ribbon to a take-up.

2. The method according to claim 1, wherein said suction conveying step is applied to said ribbon at a velocity greater than the speed of production of said ribbon, and applies tension to said ribbon.

3. The method according to claim 1, wherein said compressed gas is blown at an angle substantially tangential to the surface of said quench roll.

4. The method defined in claim 1, wherein said quench roll is substantially cylindrical and is rotated about a substantially horizontal axis, and wherein said separation point is at the lowermost location on said quench roll, wherein said ribbon is suction conveyed from a point contacting said quench roll at substantially said lowermost point, and wherein said compressed gas is a jet also aimed at substantially said lowermost point.

5. A suction conveyor for producing a thin metal ribbon comprising:

a conveyor belt having air passage holes for sucking and holding a conveyance object on the surface thereof;

a top plate having air passage holes and a plurality of intermediary members arranged on top of said top plate which provide reduced area of contact between said top plate and the back side of said conveyor belt; and a suction box positioned to suck air through said air passage holes so as to cause said conveyor belt to contact at its back surface with said intermediary members.

6. A thin metal ribbon production apparatus, comprising:

a quench roll having a peripheral surface, means for rotating said quench roll, means for supplying a molten metal onto the surface of said rotating quench roll so that said molten metal is rapidly cooled and solidified to form a thin metal ribbon;

a first-stage vacuum conveyor positioned for separating said ribbon from said quench roll and sucking said ribbon, said first-stage suction conveyor having a suction start position located adjacent said peripheral surface of said quench roll, said suction conveyor having a pivot disposed adjacent said suction start position such that the downstream end of said suction conveyors may swing up and down about said pivot between a ribbon take-up position and a ribbon disposal position; and a second-stage suction conveyor having an upstream end disposed adjacent the downstream end of said first-stage suction conveyor when said downstream end of said first-stage suction conveyor is disposed at said ribbon take-up position, so as to suck and further convey ribbon received from said first-stage vacuum conveyor.

7. A thin metal ribbon production apparatus according to claim 6, wherein the suction start position of said second-stage suction conveyor coincides with the position where the suction by said first-stage suction conveyor terminates.

8. A thin metal ribbon production apparatus according to claim 7, wherein a cutter for cutting said ribbon is disposed in the vicinity of said suction start position of said second-stage suction conveyor.

* * * * *